United States Patent [19]

Hetrick

[11] Patent Number: 4,926,573

[45] Date of Patent: May 22, 1990

[54] COVER FOR SMOKING ACCESSORY

[76] Inventor: Homer S. Hetrick, 501 Alison Ave., Mechanicsburg, Pa. 17055

[21] Appl. No.: 229,421

[22] Filed: Aug. 8, 1988

[51] Int. Cl.[5] ..... G09F 3/08

[52] U.S. Cl. ..... 40/663; 40/311; 131/270

[58] Field of Search ..... 131/329, 330, 270; 219/267, 269; 40/663, 324, 331

[56] References Cited

U.S. PATENT DOCUMENTS 1,581,006 4/1926 McClarence ..... 40/663
3,471,679 10/1969 Ohnborn ..... 219/269

FOREIGN PATENT DOCUMENTS 2235022 1/1975 France ..... 219/269

*Primary Examiner*—Gene Mancene
*Assistant Examiner*—Michael Lynch
*Attorney, Agent, or Firm*—H. Jay Spiegel

[57] ABSTRACT

Disclosed are embodiments of covers for smoking accessories. In a first embodiment, a covering device is provided designed to be snapped into place over the opening of the socket for a vehicle cigarette lighter. The covering device may have a design thereon providing an anti-smoking message. In a further embodiment, a plate is provided designed to cover an ashtray and to attach over the opening in the ashtray by a snapping connection with the cigarette holder thereof. Again, the upwardly facing surface of the plate may have an anti-smoking message thereon.

4 Claims, 1 Drawing Sheet

COVER FOR SMOKING ACCESSORY

BACKGROUND OF THE INVENTION

The present invention relates to covers for smoking accessories. The following prior art is known to applicant:

U.S. Pat. No. 1,726,166 to Sparks

U.S. Pat. No. 2,228,641 to Roser

Each teach the concept of an electrical receptacle with a plug device designed to be removably insertable into the opening of the receptacle to protect against shocks and prevent unauthorized use. However, neither of these patents teaches the concept of a device designed to be inserted into the socket of an automobile cigarette lighter and having an anti-smoking message printed thereon.

U.S. Pat. No. Des. 203,641 to McClure discloses an ashtray having structure thereon for supporting cigarettes and snuffing them out. However, there is no teaching or suggestion in this patent of a plate designed to cover such an ashtray and having an anti-smoking message thereon.

U.S. Pat. No. Des. 230,525 to Peterson discloses an ashtray made in the shape of a coffin. However, there is no teaching or suggestion in this patent of a covering plate for an ashtray as disclosed herein.

Finally, U.S. Pat. No. 3,424,123 to Giffard discloses a cigarette case having a timer mechanism incorporated therein. The case also has an anti-smoking message printed thereon. Again, there is no teaching or suggestion in this patent of the precise invention disclosed therein.

SUMMARY OF THE INVENTION

The present invention overcomes the deficiencies in the prior art as described above and provides a new and improved device which is designed to deter and prevent smoking. The present invention includes the following interrelated aspects and features:

(A) A first embodiment of the present invention consists of a covering plug made of a flexible material such as, for example, plastic and sized to be insertable into the socket opening of a vehicle cigarette lighter. Preferably, the covering plug includes an annular locking portion having a plurality of slits therein to provide flexibility which locking portion is designed to be inserted into the cigarette lighter socket whereupon the resiliency of the locking portion retains the plug in mounted position.

(B) The covering plug has an outwardly facing surface on which may be printed or otherwise displayed an antismoking message such as, for example, a cigarette with a line drawn through it.

(C) In a further embodiment, many vehicle ashtrays have structure therein including an undulating piece of wire designed to not only support a cigarette but also to assist in extinguishing cigarettes. The further embodiment of the present invention contemplates a connection means designed to interact with this undulating wire and having a plate attached thereto sized to cover the entirety of the ashtray when the connection means is connected to the undulating wire.

(D) The surface of the plate facing upwardly may have, if desired, an anti-smoking message printed or otherwise provided thereon such as, for example, a cigarette with a line drawn through it.

Accordingly, it is a first object of the present invention to provide a device designed to prevent and deter smoking.

It is a further object of the present invention to provide such a device including a plug designed to be insertable into a vehicle cigarette lighter socket.

It is a further object of the present invention to provide such a device including a plate designed to be used to cover the entirety of the opening of a vehicle ashtray.

These and other objects, aspects and features will be better understood in the following detailed description of the preferred embodiment when read in conjunction with the appended drawing figures.

SPECIFIC DESCRIPTION OF THE PREFERRED EMBODIMENTS

Figure 1:
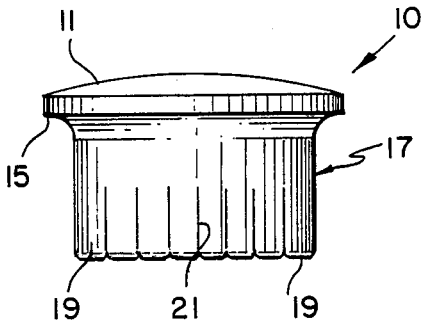
FIG. 1 shows a side view of a first embodiment of the present invention.
Figure 2:
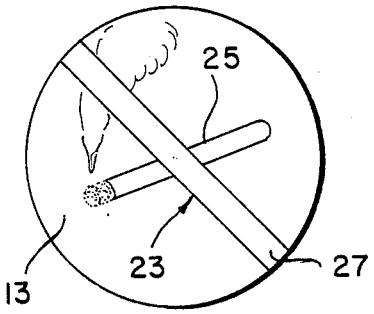
FIG. 2 shows a top view of the embodiment of FIG. 1.

With reference, first, to FIGS. 1 and 2, a covering plug 10 is seen to include a cover 11 having a convex surface 13 which extends to a margin 15. Depending downwardly from the margin 15 is an annular locking portion 17 having a plurality of fingers 19 extending circumferentialy thereabout and defined by slits 21 therebetween. With reference to FIG. 2, the surface 13 may have printed thereon a message 23 such as, for example, a cigarette 25 having a line 27 extending therethrough.

In the operation of the embodiment of FIGS. 1 and 2, a cigarette lighter is removed from its vehicle socket and the locking portion 17 of the plug 10 is inserted therein. The resiliency of the fingers 19 aids in retaining the plug 10 in mounted position therein.

Figure 3:
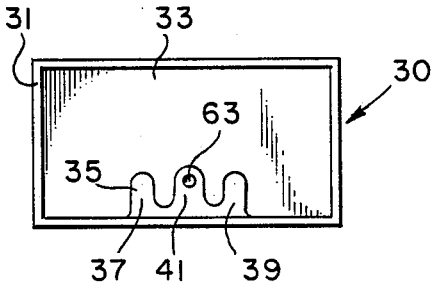
FIG. 3 shows a top view of a typical vehicle ashtray.
Figure 4:
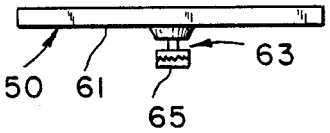
FIG. 4 shows a side view of a second embodiment of the present invention.
Figure 5:
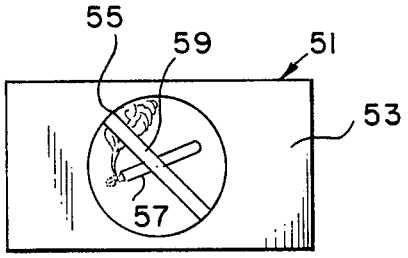
FIG. 5 shows a top view of the embodiment of FIG. 4.

With reference now to FIGS. 3, 4, and 5, a second embodiment of the present invention will now be described. FIG. 3 shows a top view of a typical vehicle ashtray 30 which has an outer periphery 31, an ash receptacle 33, and an undulating wire 35 defining three loops 37, 39, and 41. The wire 35 is provided to support cigarettes which are lit as well as to aid in the extinguishing of lit cigarettes.

With reference to FIGS. 4 and 5, a plate 50 is seen to include a cover 51 having a top surface 53 with an antismoking message 55 thereon which may, if desired, include a cigarette 57 with a line 59 extending therethrough.

With reference to FIG. 4, it is seen that depending downwardly from the bottom surface 61 of the plate 51 is a locking mechanism 63 which includes a flexible snap 65 designed to be insertable under the undulating wire of the ashtray 30 (FIG. 3) under the centrally located loop 41. With reference to FIG. 3, reference numeral 63 schematically depicts the location of the locking means 63 when the plate 50 is mounted over the ashtray 30.

Alternatively, instead of the locking means 63, an alligator type clip could be mounted on the surface 61 of the plate 51 with a swivel-type connection allowing the clip to be rotated to the appropriate position and then to be attached to the snuffer plate of the ashtray.

Of course, any locking means which locks the plate 51 over the entirety of the opening 31 of the ashtray would be appropriate.

As such, an invention has been disclosed in terms of preferred embodiments thereof which fulfill each and every one of the objects of the invention set forth hereinabove and provide a new and improved device designed to deter and prevent smoking. Of course, various changes, modifications, and alterations of the teachings of the present invention may be contemplated by those skilled in the art. For example, the covering devices disclosed hereinabove may be manufactured without a slogan on their outwardly facing surfaces. Alternatively, a phrase such as "no smoking" or any other anti-smoking message may be printed thereon. Additionally, the outwardly facing surface may be used to display advertising such as for a soft drink, food product or the like. Furthermore, the devices as disclosed hereinabove may be made in whatever shape is necessary so that they correspond with the vehicle structure with which they are to interact. As such, it is intended that the present invention only be limited by the terms of the appended claims.

What is claimed is:

1. In a cigarette lighter assembly having a socket adapted to removably receive lighter means, the improvement comprising a covering plug including:

an outwardly facing surface having an annular locking portion extending away from said surface in a direction opposite to the outwardly facing direction; and said annular locking portion having flexible locking means for securing said plug in said socket.

2. The invention of claim 1, wherein said outwardly facing surface is convex.

3. The invention of claim 2, further including an anti-smoking message on said surface.

4. The invention of claim 1, wherein said flexible locking means including a plurality of flexible fingers.

* * * * *